United States Patent [19]

Warwick

[11] Patent Number: 4,467,939

[45] Date of Patent: Aug. 28, 1984

[54] STORAGE CONTAINER WITH REMOVABLE LID

[75] Inventor: Michael J. Warwick, Northwich, England

[73] Assignee: WCB Plastics Limited, Winsford, England

[21] Appl. No.: 436,778

[22] Filed: Oct. 26, 1982

[51] Int. Cl.[3] ..... B65D 43/14; B65D 51/04

[52] U.S. Cl. ..... 220/331

[58] Field of Search ..... 220/241, 331, 242, 339, 220/345, 352

[56] References Cited

U.S. PATENT DOCUMENTS 2,792,144 5/1957 Mayer ..... 220/331
2,961,695 11/1960 Tradd ..... 220/331
3,700,392 12/1972 Sprick et al. ..... 220/331
4,054,222 10/1977 Suk ..... 220/241

*Primary Examiner*—Joseph M. Moy

[57] ABSTRACT

Security lids for stack/nest containers are frequently lost since they must be separated from such containers when the containers are in the nested condition. The present invention provides an open topped container 10 and a lid 26 with a transverse hinge 30. The lid includes means 36, 68, 70, 96, 102, for engagement on the container 24, 62, 80, 88, so that the lid cannot be removed without a combined pivoting of the lid parts about the hinge and sliding of the lid relative to the container. The folded lid can be stored in the container when another container is nested therein.

9 Claims, 9 Drawing Figures

STORAGE CONTAINER WITH REMOVABLE LID

This invention relates to a storage container having a removable lid.

It is now general practice to provide lids on containers for certain classes of goods such as pharmaceuticals, cosmetics and the like. The lids are adapted to be connected to the container for example by a seal in such a way that the lid cannot be removed from the container to gain access to the contents without breaking the seal. These so called "security containers" help to reduce pilfering of goods in storage.

The lids which are commonly in use consist of a single piece. Such lids cannot be stored in the empty containers and must, therefore, be collected separately. Thus the lids are frequently lost or cannot be found when the empty container is being returned for refilling.

The present invention has been made with this problem in mind.

According to the invention there is provided a container having a removable lid, said container comprising a floor and side walls and an open top, the lid being transversely hinged, means being provided on said lid for engagement with the underside of the rim of the container whereby the lid cannot be removed from the container without combined pivotal movement about the said hinge and sliding movement of the lid relative to the container.

According to a preferred embodiment of the invention the hinge in the lid is provided in such a position that the lid can be folded and thereby stored in the empty container. To that end the dimensions of the folded lid should be no greater than the internal dimensions of the container. It is convenient to locate the hinge so that it divides the lid in half. However, that is not essential. If desired more than one hinge can be provided so that the lid can be folded more than once for storage purposes.

Specific embodiments of the invention will now be described by way of example with reference to the accompanying drawings in which.

In the drawings like parts of the different embodiments have been given the same reference numerals.

Figure 1:
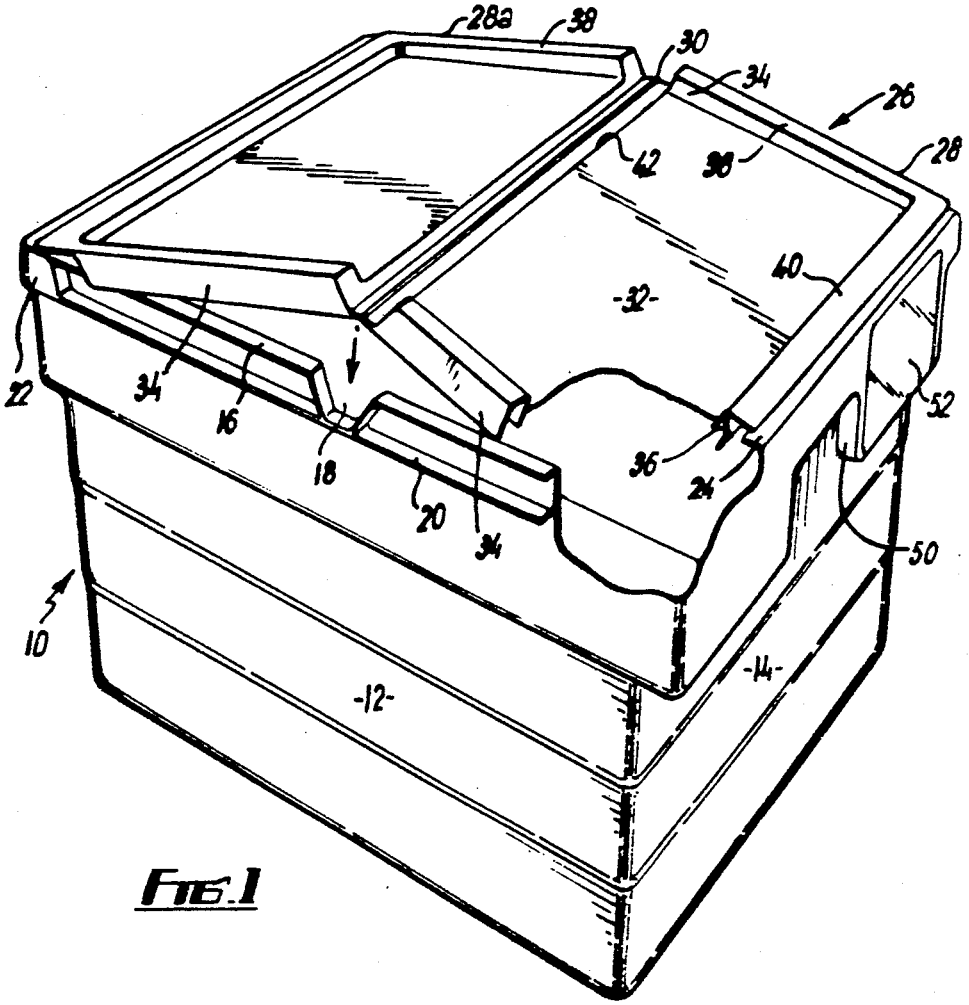
FIG. 1 is a perspective view of a container and lid, partly in section and with the lid partly removed from the container.

Referring to the drawings a container 10 of rectangular plan comprises side walls 12 and end walls 14. The walls are successively stepped inwardly towards the base and each step of the wall is itself inclined inwardly towards the base by a small angle, for example ½°. The container can, therefore, be nested within another like empty container.

The stepped construction is not essential and a container adapted for nesting can be provided by means of continuously inclined side walls. It is to be understood moreover that the invention can be applied to containers which do not nest one with another.

The top of the side walls of the container are formed with an unhinged flange 16. Midway along each side wall a generally U-shaped depression 18 is formed, the purpose for which will become apparent. A reinforcing rib 20 extends on the outside of the side walls 12 parallel to flange 16. The rib 20 extends through the bottom of the U-shaped depression 18. The channel defined between the flange 16 and rib 20 is closed adjacent each end thereof as at 22.

The top of each end wall 14 is formed with an inturned flange 24. The flanges 16 and 24 meet at each corner of the container so as to provide a continuous rim around the container top. Preferably the width of flanges 16 and 24 is the same.

The container can be closed by a lid 26. The lid consists of two substantially identical parts 28 and **28*a* joined together by a hinge 30**. If the lid is made of plastics the hinge may be an integral plastic hinge of the kind known per se.

Each lid part comprises a flat sheet 32 of rectangular shape. A U-shaped channel 34 extends along each shorter side of sheet 32 with the open side of the channel directed downwardly. Another U-shaped channel 36 extends along the long edge of sheet 32 opposite the hinge, the open side of channel 36 being directed outwardly. It is preferred, as shown in the illustrated embodiment that the web 38 of channel 34 should join the end rim 40 (which forms part of channel 36) so as to form a continuous rim around the lid. It is also preferred, as illustrated, that the said continuous rim should be slightly above the level of the sheet 32 so that a wall is formed around three sides of the sheet. At the fourth side of the sheet 32 the lid is stepped down, as at 42, to the hinge 30.

The lid is fitted onto the container in the following way. The two lid parts 28 and **28*a* are slightly inclined to each other as illustrated in FIG. 1 and the channels 34 located over the flanges 16. Pressure is applied to the lid to cause each end thereof to approach the end walls 14 of the container. The application of pressure as aforesaid eventually causes channels 36 to receive flanges 24 and at the same time each end of the stepped down portion of the lid containing the hinge is received in recess 18**.

Figure 2:
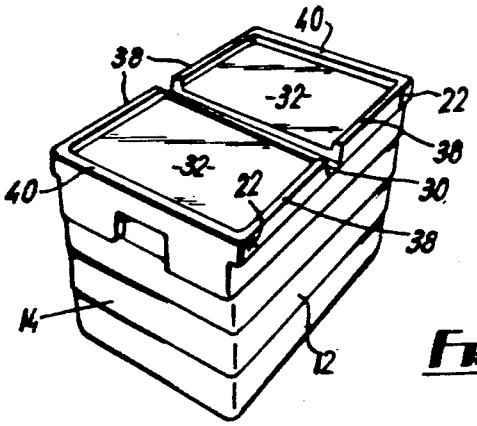
FIG. 2 illustrates the container fully closed by the lid.

Finally the inner surfaces of the webs 38 of channels 34 come to rest on the flanges 16, the aforesaid ends of the stepped down portion containing the hinge rest on the bottom of recess 18 and the under sides of end rims 40 of channels 36 rest on the tops of flanges 24. FIG. 2 shows the lid in its closed position. The lid can be sealed to the container by means known per se. For example the lid can be sealed in one or more places by a fastening device which extends through the lid and is received by the container. Once sealed it is virtually impossible for anyone to gain access to the container without breaking the seal.

In the embodiment illustrated in FIGS. 1 and 2 of the drawings the outer side wall of channel 34 is dimensioned so that when the lid is closed, the said side wall extends at least as far as ribs 20. It will be noted that channels 34 do not extend to the end of the lid but stop short so as to accommodate the filled in portion 22.

The shape of the channel 36 is not regular in that the lower side wall is downwardly inclined in order to ease fitting and removal of the lid.

It is preferred that the sheets 32 should, when the lid is closed in the container, be slightly inclined towards the stepped down portion containing the hinge. Such an arrangement will cause rain water to drain from the sheets 32 to the hinge and out through recess 18, where the hinge sits in the depression, if the container is stored in the open.

The container may have a small receptacle 50 formed on end wall 14 having a transparent external wall 52, for receiving a label through a slot (not shown) in flange 24. When the lid is closed on the container the label cannot be removed from the receptacle because the slot is covered by rim 40.

When the container is empty the folded lid can be placed at the bottom thereof without in any way interfering with the nesting therein of another container. While the container is being emptied the folded lid can be conveniently stored by locating on suitably positioned rods the tubes formed by the channels 34 on each part 28 and 28*a* coming together.

Figure 3:
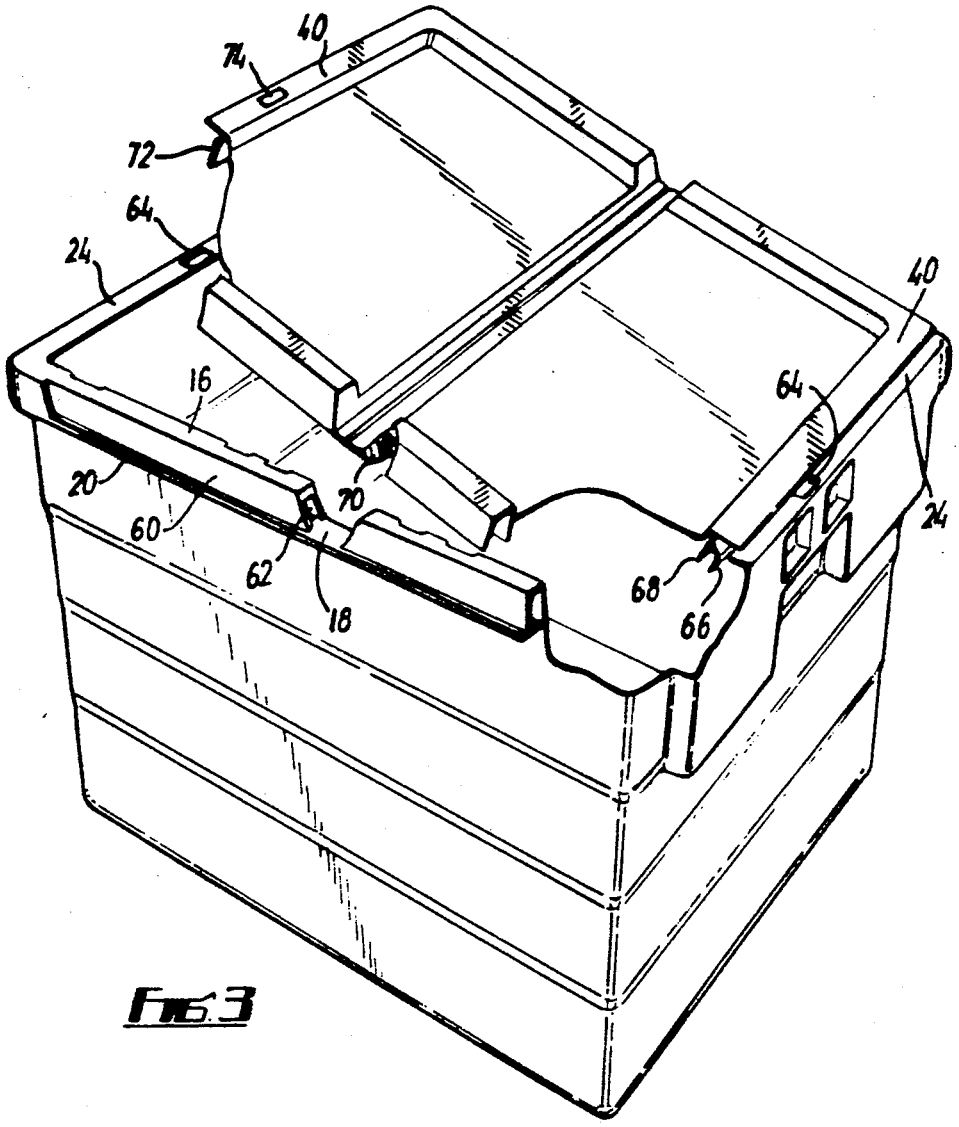
FIG. 3 is a part sectional perspective view similar to that of FIG. 1 of another embodiment.

The embodiment of FIG. 3 is somewhat similar to that of FIG. 1 except that the way in which the lid is secured to container is modified.

The container in FIG. 3 is substantially the same as the container of FIG. 1 except that the space between flange 16 and rib 20 on the side walls is closed by a wall 60. Apertures 62 are formed in the sides of the depressions 18. Apertures 64 are also provided in the flange 24 at the mid point of each end wall.

The lid is provided at one end with a channel 66 similar to channel 36 of the embodiment of FIG. 1 except that a reinforcing rib 68 is provided behind the channel. A lug 70 is provided inside the right hand parts of channels 34 (as viewed in the drawing) the lug is located at the end of said channel parts adjacent the hinge and is directed towards the lid end having channel 66 thereat. The other (left hand) end of the lid has a snap closure member 72 projecting downwardly from rim 40.

Figure 4:
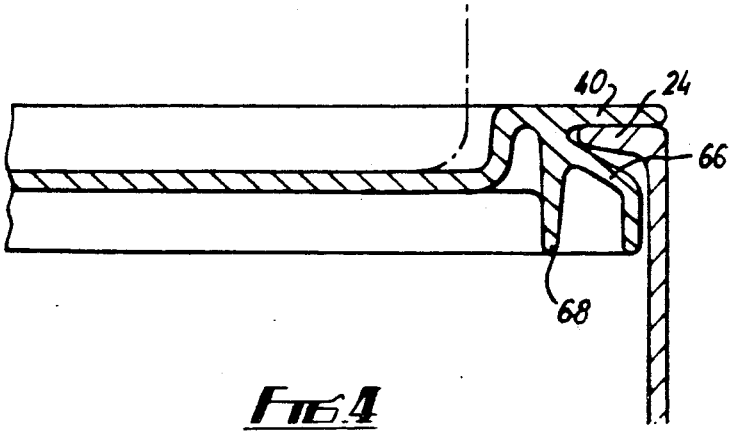
FIG. 4 is a part section through the right hand end (as viewed in FIG. 3) of the lid of the embodiment of FIG. 3.
Figure 5:
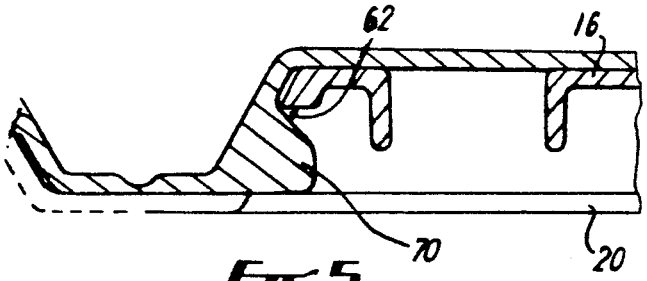
FIG. 5 is a part section through the middle of the lid of the embodiment of FIG. 3.
Figure 6:
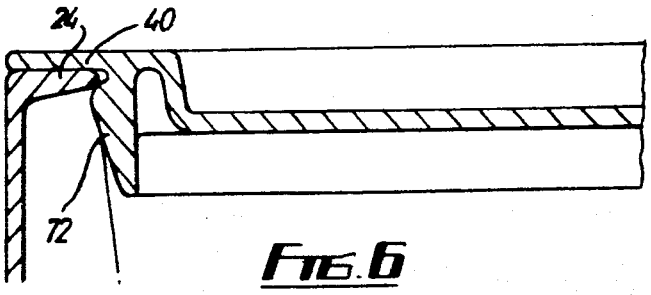
FIG. 6 is a part section through the left hand end of the lid of the embodiment of FIG. 3.

The lid is fixed onto the container by locating the right hand end of the lid with the channels 34 resting over flanges 16. The lid is then moved towards the right so that flange 24 of the container is received in the channel 66 (FIG. 4) and at the same time lug 70 enters aperture 62 (FIG. 5). The left hand end of the lid is then pivotted downwardly about the hinge and the snap closure member 72 fastens on the flange 24 and the left hand end of the container (FIG. 6). The lid can be sealed to the container by a fastener which extends through the aperture 74 in rim 40 and into aperture 64 in the flange 24 of the container.

In some instances a container may be required whose interior is clear of any in-turned flanges such as flanges 24 in the previously described embodiments. The invention can provide for that requirement for example by the embodiment of FIGS. 7 to 9 which will now be described.

Instead of in-turned flanges 24 at each end the container has an external flange projection 80. The projection is substantially S-shaped in cross-section thereby defining an upwardly directed channel 82 adjacent the container and a downwardly directed channel 84 remote from the container.

Figure 7:
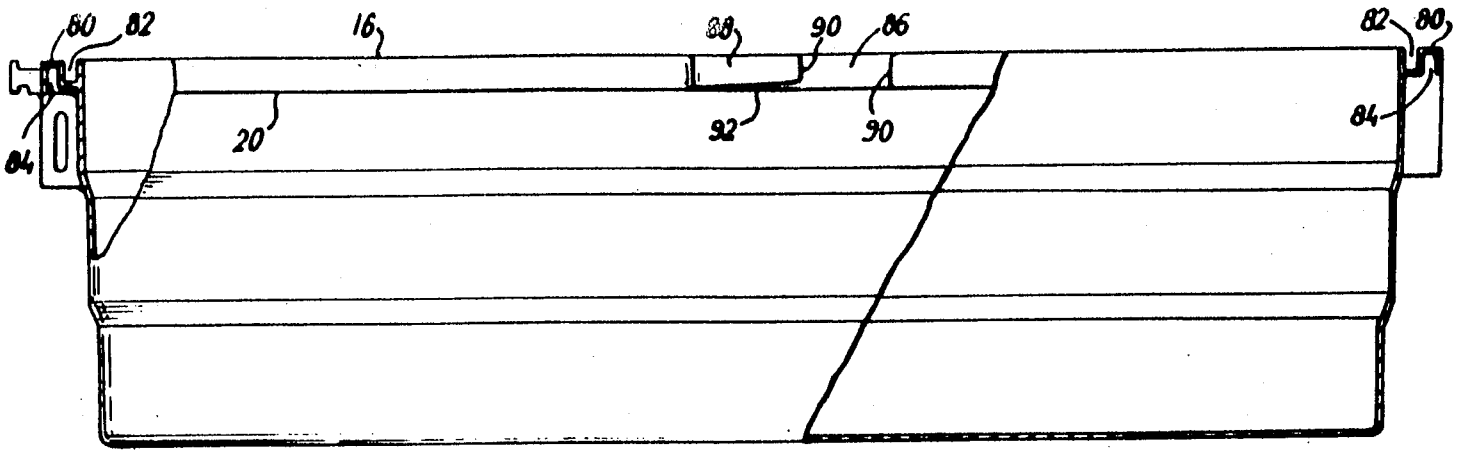
FIG. 7 is a side elevation, partly in section of another embodiment of a container and lid.
Figure 8:
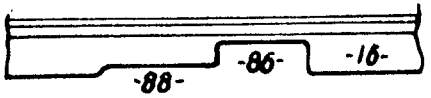
FIG. 8 is a plan view of a part of the rim of the embodiment of FIG. 7.

The side walls of the container have an out-turned flange 16 as before but in place of the recess 18 a cut out 86 is formed to one side of the transverse centre line of the container. A smaller cut out 88 is formed in the flange 16 on the centre line and beside cut out 86. Walls 90 extend on either side of cut out 86 to the rib 20. As can be seen in FIG. 7 the rib 20 is inclined slightly upwardly at 92 as it extends beside cut out 88 to the appropriate wall 90.

Figure 9:
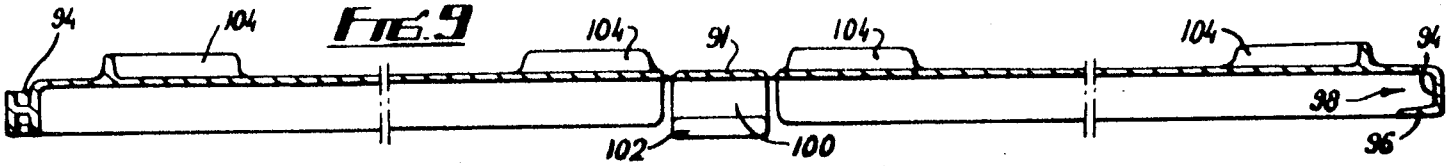
FIG. 9 is a section through the lid of the embodiment of FIG. 7.

The lid is shown in section in FIG. 9 and comprises two parts each hinged to a central member 91. A downwardly directed flange 94 is provided at each end of the lid. At one end only the flange 94 is in-turned as at 96 to define a channel 98. A wall 100 extends downwardly at each end of the member 91. A lug 102 is provided on the inner surface of wall 100 at the lower end thereof.

The lid is fixed to the container in the following way. The right hand end of the lid is placed on the container so that wall 100 and lug 102 at each end of member 91 drop through cut outs 86. The lid is then moved to the left so that projection 80 is received in channel 98 and so that lug 102 passes below surface 92. At the same time wall 100 is received in cut out 88. The left hand end of the lid is now pivotted downwardly and can be secured in any convenient way.

It will be noted that in the embodiment just described the upper surface of the lid can be made flat. If positive location for stacking of another container on the lid is required projections 104 can be provided on the lid.

It will be evident that the invention can be applied to many existing containers which already have the necessary formations for engagement of a lid thereon in accordance with the invention. Moreover, many existing containers can be modified to make them suitable for use in the present invention.

If desired the containers may be fitted with transverse wires, as is known per se, the ends of which are pivotably mounted in the side walls of the container so as to permit movement of the wires from a stacking position where they extend across the container and support another container and a nesting position not obstructing access to the container whereby another container can be nested in the said container. A channel can be formed in flange 24 to receive a wire in the nested position. Preferably the lid is arranged to fit on the container regardless of whether the wire is in the stacking or nesting position. When in the former it provides support below the lid which can be useful where heavy loads are placed on the lid.

The provision of a hinged lid in accordance with the invention permits the container to be used with half the lid permanently in place, the other half being lifted when access to the container contents is required. The embodiments of FIGS. 3 and 7 are particularly adapted for use in this way.

Although the hinge specifically described is of a specialised nature it is to be understood that other kinds of hinges may be used including detachable hinges. For example the lid may comprise two or more separate parts which interlock together to permit the pivotal movement required by the invention. The term hinge as used in the specification also includes constructions where the lid material can flex in the manner of a hinge.

The lid may be provided with a clip for holding the lid in the folded condition. When the lid is of plastics the clip can conveniently comprise a lug on one lid part which is a snapfit in a suitably profiled piece on the other part.

In the embodiments described the security plug or pin is inserted through the top of the lid into the container. It can equally well be inserted through a side wall of the lid into the side of the container.

I claim:

1. A lidded container comprising:

a floor;

opposed planar side walls upwardly extending from said floor;

opposed upwardly extending planar end walls between said side walls, said floor side walls and end walls enclosing an open topped rectangular volume;

a rectangular lid dimensioned to overlie the top of said container, said lid molded with two lid parts connected by a hinge region which extends transversely relative to said side walls when the lid is fitted to close said container;

a flange on an end wall of said container adjacent the upper edge thereof;

means on said lid adapted to engage the underside of said flange and to extend over the upper edges of said side and end walls, said lid being fittable to and removable from said container by combined pivotal movement about said hinge region and sliding movement relative to said container and parallel to said side walls to engage and disengage a part of said lid beneath said flange;

downwardly opening channels on said lid receiving the upper edges of said opposed side walls during fitting of the lid to the container;

recesses in the upper edges of said opposed side walls within which portions of the hinge region adjacent to said side walls are received when the lid is lowered into engagement with the upper edges of said side walls.

2. A container as in claim 1 in which said flange on said end wall is inside said container and the part of said lid which engages the underside of said flange comprises a channel; and a rim on said lid extending over the upper edge of said end wall.

3. A container as in claim 1 in which said flange on said end wall is outside the container and said means on said lid adapted to engage therewith comprises a channel which is slideable to extend over the upper edge of said end wall which carries said flange.

4. A container as in claim 1 in which a flange is provided on each end wall adjacent to the open top and means is provided on the lid for engagement with the underside of each said flange, at least one said flange of an end wall being located inside said container.

5. A container as in claim 1, in which on fitting said lid to said container the hinge region engages with said side walls adjacent to said recesses to restrain the region from being lifted relative to said container.

6. A container as in claim 5, in which depressions and lugs are provided on said side walls and said lid which snap engage.

7. A container as in claim 5, in which the hinge region comprises downwardly extending lugs which are received in said recesses and are slideable with said lid relative to said container to engage said lugs beneath overlying parts of said side walls and provide the restraint to lifting of said lid relative to said container.

8. A container as in claim 1, in which a central region of said lid is depressed relative to its marginal side edge portions, said depression contoured to receive the floor of a similar container to provide a positive location when stacking one container on another.

9. A container as in claim 1, in which with said lid fitted to said container, said lid parts slop downwardly towards the hinge region which forms a drainage channel from said lid.

* * * * *